United States Patent [19]

Alden, Jr.

[11] Patent Number: 4,664,069

[45] Date of Patent: May 12, 1987

[54] REMOVAL OF SUSPENDED SLUDGE FROM NUCLEAR STEAM GENERATOR

[75] Inventor: John W. Alden, Jr., Chattanooga, Tenn.

[73] Assignee: Combustion Engineering, Inc., Windsor, Conn.

[21] Appl. No.: 686,058

[22] Filed: Dec. 24, 1984

[51] Int. Cl.[4] ..... F22B 37/54; F28F 15/00; F28G 9/00

[52] U.S. Cl. ..... 122/381; 122/32; 122/34; 122/382

[58] Field of Search ..... 122/32, 34, 381, 382, 122/385; 165/119

[56] References Cited

U.S. PATENT DOCUMENTS

| | | | |
|---|---|---|---|
| 3,227,142 | 1/1966 | Bell et al. | 122/34 |
| 3,906,905 | 9/1975 | Andrieu et al. | 122/32 |
| 4,303,043 | 12/1981 | Redding | 122/382 |

*Primary Examiner*—Edward G. Favors
*Attorney, Agent, or Firm*—Robert L. Olson

[57] ABSTRACT

A shell and tube heat exchanger (2) having a vertical dam (50) surrounding one of the steam-water separators (26*a*), so as to create a low flow velocity or quiescent area where solids will settle out. The dam encircles an area seven times greater than the average area per-separator throughout the rest of separating deck, so that there is a low flow velocity. Also, an orifice (52) is positioned in the inlet to the dammed in separator, to further reduce the flow velocity. The settled out solids are removed from the steam generator through a blow-down pipe (60).

5 Claims, 4 Drawing Figures

REMOVAL OF SUSPENDED SLUDGE FROM NUCLEAR STEAM GENERATOR

BACKGROUND OF THE INVENTION

In present day nuclear steam generators of the shell and tube type, problems are encountered by solids that settle out of the secondary liquid. These solids generally settle out on the upper face of the tube sheet, with annual accumulations of several hundreds pounds, several inches in depth. This sludge, containing magnetite-copper compounds from the feed water heater, condenser, etc., may corrosively attack the inconel tubes of the steam generator, and over a period of years can cause many of the tubes to fail, requiring these tubes to be sleeved or plugged and effectively removed from service. Many steps have been taken to relieve this sludge build-up problem. Better materials have been used in the feed water heaters and condensers; flow distribution plates have been positioned above and close to the tube sheets to increase flow velocities; and sludge lancing of the formed sludge deposits with high pressure jets is done during scheduled outages to break and remove such deposits. Even with the above steps taken, sludge deposits on the upper surface of the tube sheet remain a problem.

SUMMARY OF THE INVENTION

According to the present invention there is provided in a shell and tube heat exchanger a quiescent area where the flow is below the threshold velocity of the fine solids contained in the secondary or heated fluid so that these solids will settle out and can be easily removed from the steam generator by means of a blowdown pipe, while the unit is in operation. This quiescent area is created on the steam separator support deck of the unit by surrounding or completely encircling one of the separators located closely adjacent to the vertical axis of the generator with a vertical weir or dam. The dam has contained within it a cross-sectional area approximately seven times greater than the average area per separator throughout the rest of the deck, so that there is very low flow velocity flowing over the dam at the periphery of this area. The solids settled out within the dam can be removed through a blowdown pipe.

DESCRIPTION OF THE PREFERRED EMBODIMENT

Figure 1:
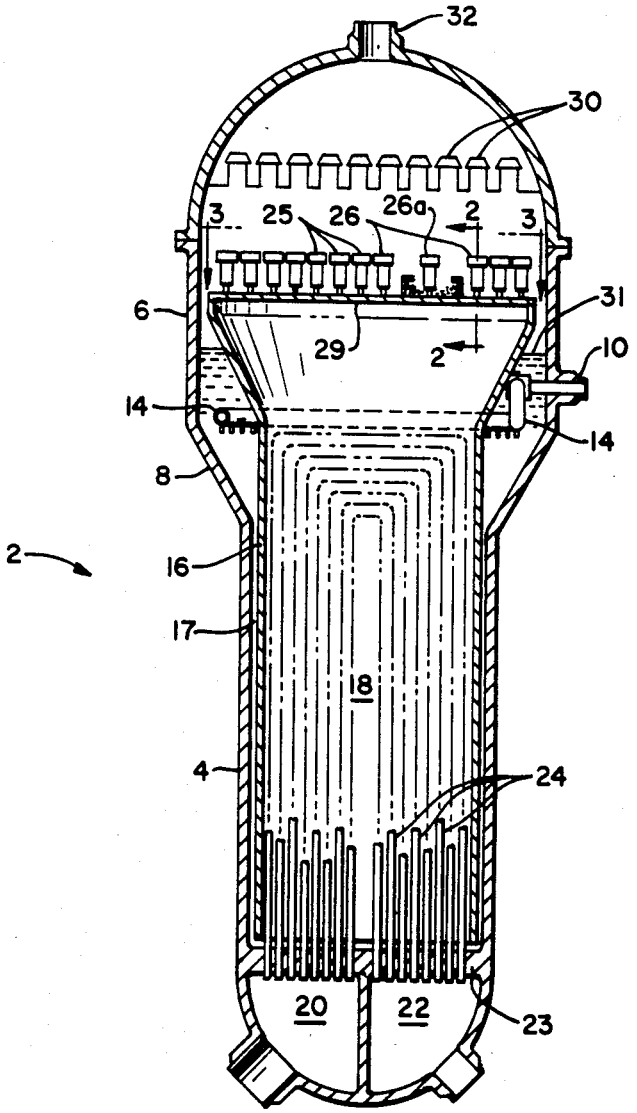
FIG. 1 is a vertical section of a typical shell and tube heat exchanger equipped with apparatus of the present invention.

Looking now to FIG. 1, there is shown a shell and tube type heat exchanger 2, having a vertically elongated pressure vessel defined by a lower cyclindrical shell section 4 and a larger diameter, upper cyclindrical shell section 6, the latter being integrally connected with the former by means of a frustoconical transition member 8. Feedwater enters the vessel through inlet 10 and flows into the annular ring distribution header 14. This water is discharged through a plurality of openings in the header 14 which openings are evenly distributed around the entire circumference of the header. The water flows downwardly between an inner shroud 16 and the walls of the vessel, through the annular downcomer 17. The water upon reaching the bottom of the vessel flows beneath the lower edge of shroud 16 into the central riser portion 18 of the vessel, where it is heated by the primary heating fluid flowing within the tubes 24.

The heating medium enters tubes 24 from inlet manifold 20, and exits by way of outlet manifold 22. The water after being heated to the point where some steam has been generated, flows through openings in upper plate or deck 29 and then through the steam-water separators 25 and 26, where a majority of the water is separated and flows over the outer edge of the deck 29 to the water level 31 and downward into the annular downcomer between the vessel wall and the shroud 16 to be recycled. In typical shell and tube heat exchangers, the mixture by weight entering the separators is three parts water and one part steam. Thus three-fourths of the entire mixture is separated out and recycled back to the downcomer 17, with the separated steam replaced by the feed water flow from the inlet 10.

The steam continues its upward flow through a plate dryer section 30 where most of the moisture remaining in the now relatively dry steam is removed. The dried steam exits through outlet 32 to its point of use, for example in driving a turbine.

Figure 2:
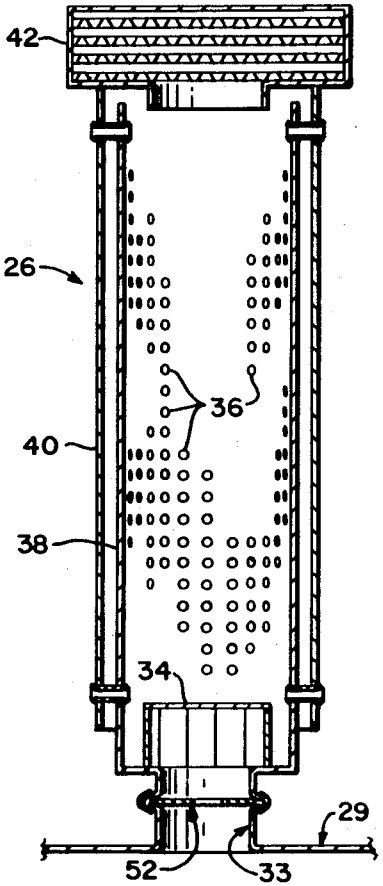
FIG. 2 is a view taken on line 2—2 of FIG. 1.

Looking now to FIG. 2, the structure of a special water-steam separator 26 is shown. Each of the special separators 26, one being located within and the others immediately external to the dam, are of this special or jacketed type. The remaining separators 25 are of the unjacketed type. A circular opening 33 is provided in the deck 29. The steam-water mixture passing upwardly through this opening encounters a spinning vane assembly 34, which causes the mixture to flow spirally upwardly. Above the spinning vanes 34, there are a large number of holes 36 in the walls of cylindrical member 38. These holes allow most of the heavier water to separate out due to centrifugal force. This separated water impinges on the walls of the cylindrical jacket 40 running downwardly thereon, and falls off the lower edges of jacket 40 onto the upper surface of plate or deck 29 the jacket cut down on turbulence in the area of the dam.

The steam-water mixture exiting from the top of member 38 passes through a plurality of bent plates 42, which form a series of tortuous paths, where the flow is continuously changing direction, causing most of the remaining water to separate out and fall back down onto the deck 29. The remaining mixture, now containing very little water, flows on to the driers 30 (FIG. 1) where the last of the water is separated out.

Figure 3:
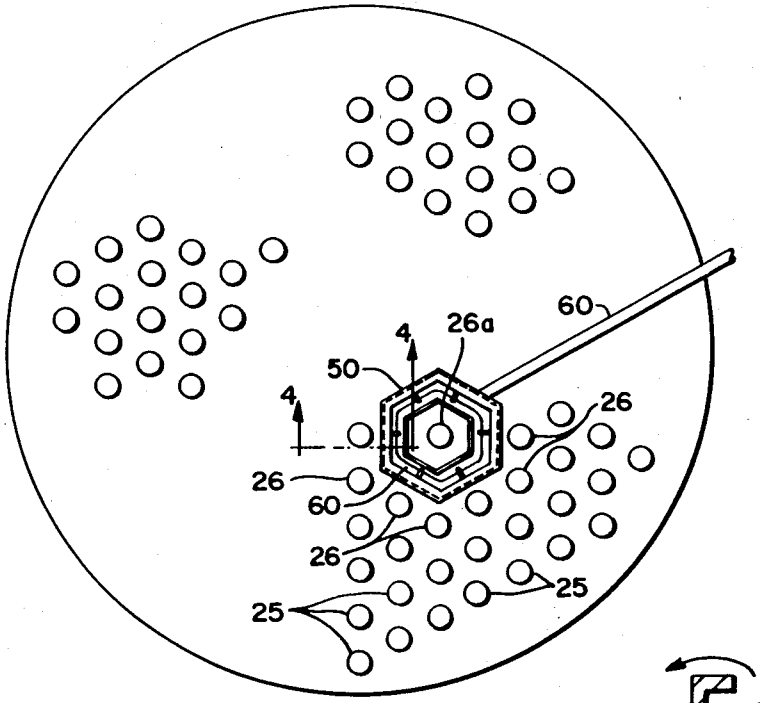
FIG. 3 is a view taken on line 3—3 of FIG. 1.

Looking now to FIG. 3, a top view of the deck 29 can be seen. Generally, there are approximately 160 steam-water separators 25 and 26 connected to the deck 29. These are generally equally spaced across the entire surface of the deck 29 either in a triangular pitch pattern as shown or a square pitch pattern.

In accordance with the invention, one of separators **26*a* is surrounded by a vertical dam or weir 50. The dam 50 encircles or encloses a cross-sectional area that would normally contain seven separators; i.e. the dam encircles a cross-sectional area seven times greater than the average area per separating means throughout the rest of the deck 29. Thus very low velocity flow exists at the periphery of the area encompassed by the dam 50. In this quiescent area, the flow velocity is below the threshold velocity of most solids in the mixture and thus they settle out at this point. The separator 26a is located closely adjacent to the vertical axis of the steam generator, so that separated water from the other separators flowing radially outward across the separator support deck 29 will not enter the dammed in area, which would cause higher flow velocity and turbulence. Also if it is desired to decrease the flow even further, an orifice 52 (FIG. 2) can be positioned in the inlet to the separator 26a**, so that only 70–80% as much steam and water enters this separator as that which enters the other separators.

Figure 4:
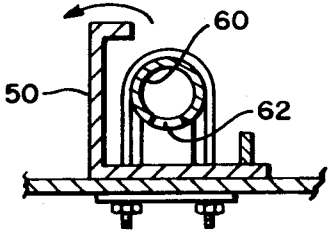
FIG. 4 is a view taken on line 4—4 of FIG. 3.

As seen in FIGS. 3 and 4, solids that settle out are removed from within the dam 50 through blowdown pipe 60 which can either be operated continuously or on a periodic basis. Most of the solids will settle out closely adjacent to the wall of the dam, so the inlets 62 to the blowdown pipe are positioned around the entire periphery of the dammed in area.

Although solids settle out of a very small percentage of the entire steam generator flow (only one separator out of approximately 160), the total flow of the steam generator passes through the separators approximately twice each minute, or 120 times an hour. Thus for a typical steam generator of about 160 separators, all of the flow should theoretically pass through each and every separator about every one and one-third hours.

The flow velocity within the dam should be far less than the velocity at any other point within the steam generator. Thus very fine particles of solids should preferentially settle out at this point. If enough fines settle out at this point, they will not have a chance to agglomerate to a size where they will settle out on the upper surface of the tube sheet 23 (FIG. 1) where they may cause tube corrosion. Although the preferred arrangement proposes the dam encircling a cross sectional area seven times the average area per separating means, some benefit will be gained with a somewhat less area. The area encircled will depend somewhat on the layout of the separators. On a square pitch pattern, an area four times greater may be most convenient and still be beneficial.

I claim:

1. In a shell and tube heat exchanger, a vertical vessel, tubes within the vessel through which heating fluid passes, means for introducing fluid to be heated to the vessel, a horizontal deck located in the upper portion of the vessel, a plurality of equally spaced separating means connected to the deck, opening means in the deck through which heated fluid flows to each of the separating means, a vertical wall means positioned within the vessel having a circular cross-section, for forming an annular downcomer, the water separated out in the separating means flowing off the edge of the deck into the downcomer, an opening in the upper portion of the vessel above the separating means through which steam can be discharged, one of the separating means being completely surrounded by an upright dam, the dam encircling a cross-sectional area at least four times greater than the average area per separating means throughout the rest of the deck so that a quiescent area is created where solids will settle out, and a blowdown pipe having an inlet disposed within the dam communicating with the exterior of the vessel for the discharge of such settled solids.

2. The shell and tube heat exchanger set forth in claim 1 wherein the inlet of the blowdown pipe is circular and is in communciation with the area within the dam closely adjacent to the dam around its entire periphery.

3. The shell and tube heat exchanger set forth in claim 2, wherein the dam encircles a cross-sectional area at least seven times greater than the average area per-separating means throughout the rest of the deck.

4. The shell and tube heat exchanger set forth in claim 1, wherein said one separator is located closely adjacent to the vertical axis of the vessel.

5. The shell and tube heat exchanger set forth in claim 1 wherein said one separator has a restriction located in its opening means.

* * * * *